US008919155B2

(12) United States Patent
Lai

(10) Patent No.: US 8,919,155 B2
(45) Date of Patent: Dec. 30, 2014

(54) PADLOCK WITH FULLY INTEGRATED DUAL LOCKING SYSTEM

(71) Applicant: The Sun Lock Company, Ltd., Tuen Mun, N.T. (HK)

(72) Inventor: Karl Lai, Hong Kong (HK)

(73) Assignee: The Sun Lock Company Ltd., Tuen Mun, N.T. (HK)

( * ) Notice: Subject to any disclaimer, the term of this patent is extended or adjusted under 35 U.S.C. 154(b) by 161 days.

(21) Appl. No.: 13/758,066

(22) Filed: Feb. 4, 2013

(65) Prior Publication Data

US 2014/0026626 A1 Jan. 30, 2014

Related U.S. Application Data

(60) Provisional application No. 61/676,611, filed on Jul. 27, 2012.

(51) Int. Cl.

| | |
|---|---|
| ***E05B 37/06*** | (2006.01) |
| ***E05B 37/00*** | (2006.01) |
| ***E05B 35/10*** | (2006.01) |
| ***E05B 37/02*** | (2006.01) |

(52) U.S. Cl.

CPC ..... *E05B 37/0034* (2013.01); *E05B 37/0068* (2013.01); *E05B 35/105* (2013.01); *E05B 37/025* (2013.01); *E05B 37/0058* (2013.01)

USPC ..... 70/21; 70/24; 70/25; 70/184; 70/285

(58) Field of Classification Search

CPC ..... E05B 35/105; E05B 37/0034; E05B 37/0058; E05B 35/10; E05B 47/0603; E05B 47/0642; E05B 47/068; E05B 65/52; E05B 37/0068; E05B 37/025; E05B 67/22; E05B 67/24

USPC ..... 70/21, 24–30, 284, 285

See application file for complete search history.

(56) References Cited

U.S. PATENT DOCUMENTS

| | | | | |
|---|---|---|---|---|
| 2,133,528 | A | 10/1938 | Bell | |
| 6,904,776 | B1 * | 6/2005 | Lin | 70/25 |
| 6,997,023 | B1 | 2/2006 | Huang | |
| 7,047,773 | B1 | 5/2006 | Lin | |
| 7,363,782 | B1 * | 4/2008 | Misner et al. | 70/21 |
| 7,523,628 | B2 * | 4/2009 | Yu | 70/21 |

(Continued)

FOREIGN PATENT DOCUMENTS

GB 2491621 A 12/2012

*Primary Examiner* — Suzanne Barrett

(74) *Attorney, Agent, or Firm* — Ware, Fressola, Maguire & Barber LLP

(57) ABSTRACT

A padlock includes a housing and a shackle positionable between an open position and a closed position. The shackle may be retained in its closed position within the housing by a latch that is operatively connected to a key locking mechanism and a combination locking mechanism. The latch may be disengaged from the shackle so that the shackle may be placed into the open position when the key locking mechanism is placed in an unlocked orientation or the combination locking mechanism is placed in an unlocked configuration. The key locking mechanism may include a cylinder configured for operative engagement with the latch, and the combination locking mechanism may include a button configured for operative engagement with the latch and a spindle configured to restrict movement of the button. In the unlocked configuration of the combination locking mechanism, the combination used for the combination locking mechanism may be reset and/or reconfigured.

18 Claims, 14 Drawing Sheets

(56) References Cited

U.S. PATENT DOCUMENTS

| | | | | |
|---|---|---|---|---|
| 7,698,913 | B2 * | 4/2010 | Lee | 70/21 |
| 7,779,657 | B2 * | 8/2010 | Yu | 70/21 |
| 8,011,212 | B2 * | 9/2011 | Yu | 70/21 |
| 8,171,760 | B2 * | 5/2012 | Yen et al. | 70/25 |
| 8,776,556 | B2 * | 7/2014 | Lai | 70/21 |
| 2008/0011026 | A1 | 1/2008 | Huang | |
| 2008/0083251 | A1 | 4/2008 | Lai et al. | |
| 2008/0098774 | A1 * | 5/2008 | Huang | 70/21 |
| 2008/0223088 | A1 | 9/2008 | Yang | |
| 2008/0307839 | A1 | 12/2008 | Yu | |
| 2010/0064738 | A1 * | 3/2010 | Yi | 70/24 |
| 2011/0289988 | A1 * | 12/2011 | Yu | 70/284 |

* cited by examiner

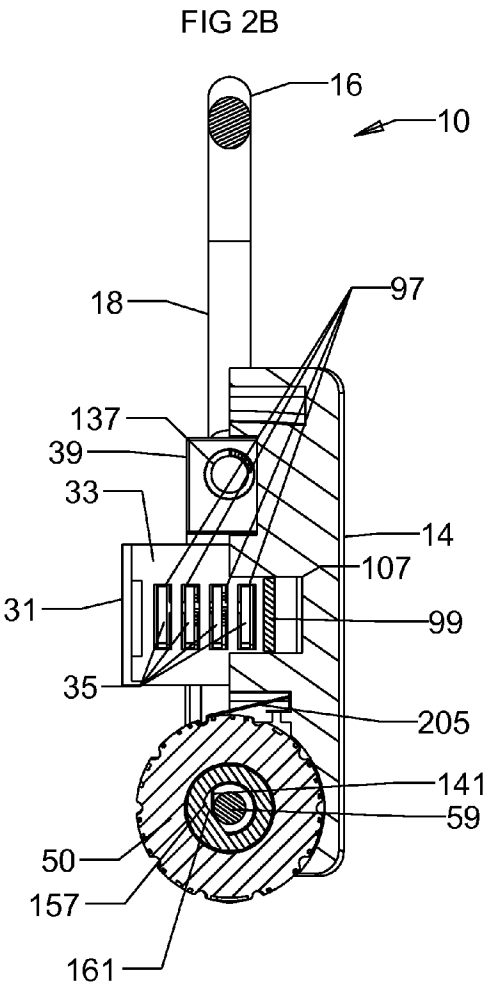
FIG 2B
10
16
97
14
107
99
205
141
59
18
137
39
33
31
35
50
157
161
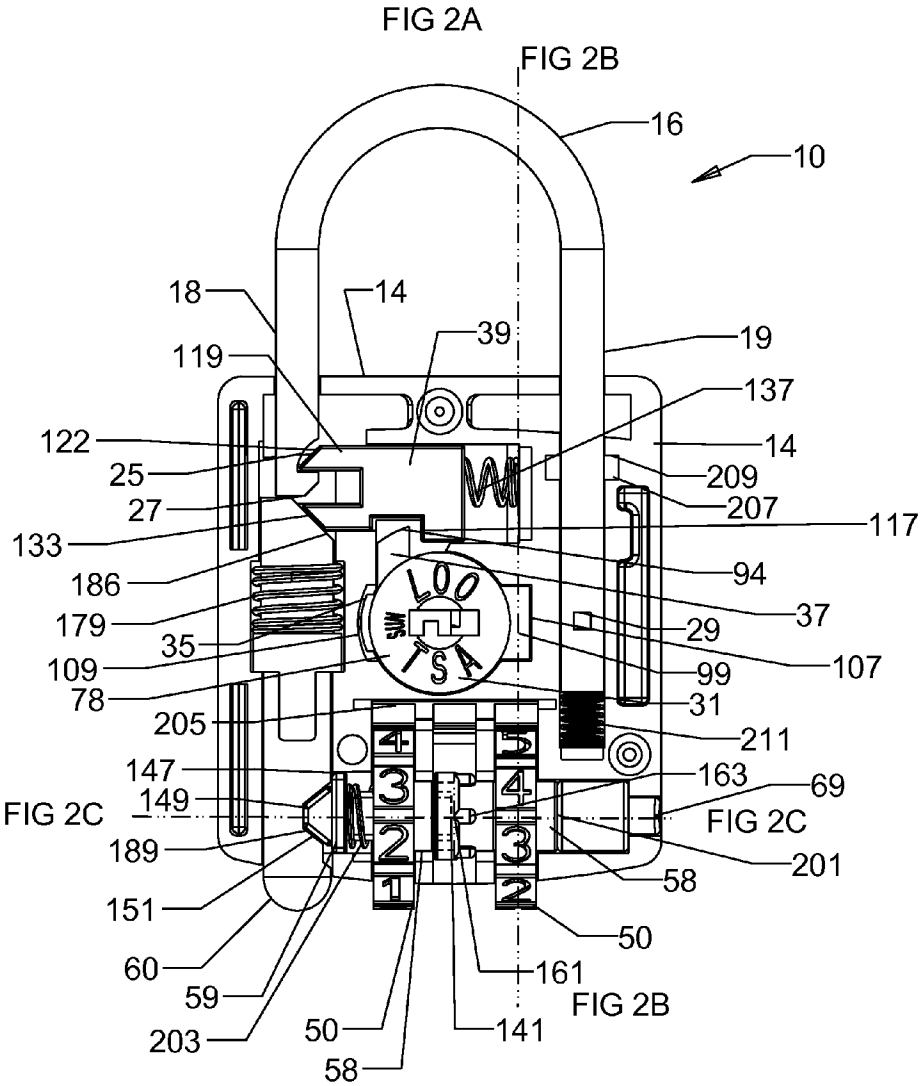
FIG 2A
FIG 2B
10
16
19
137
14
209
207
94
37
107
117
29
99
31
211
163
69
FIG 2C
201
58
50
161
141
39
14
18
119
122
25
27
133
186
179
35
109
78
205
147
149
FIG 2C
189
151
60
59
203
50
58
FIG 2B FIG 14A
FIG 14B
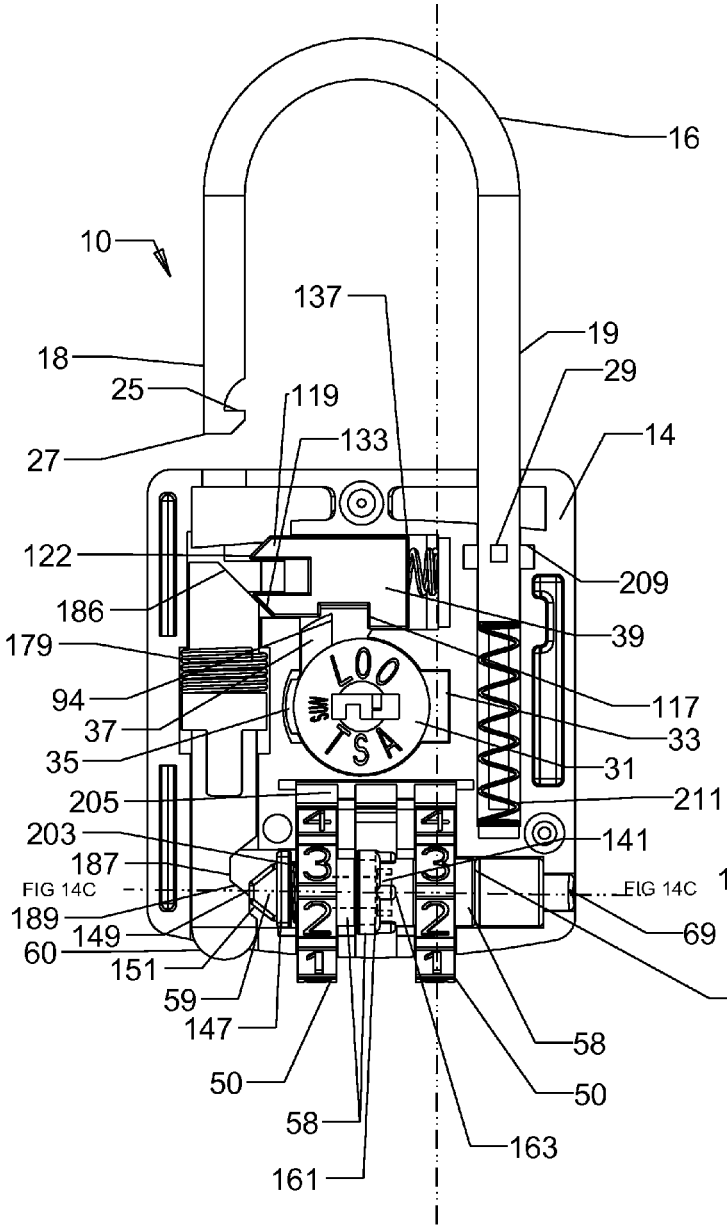
FIG 14B
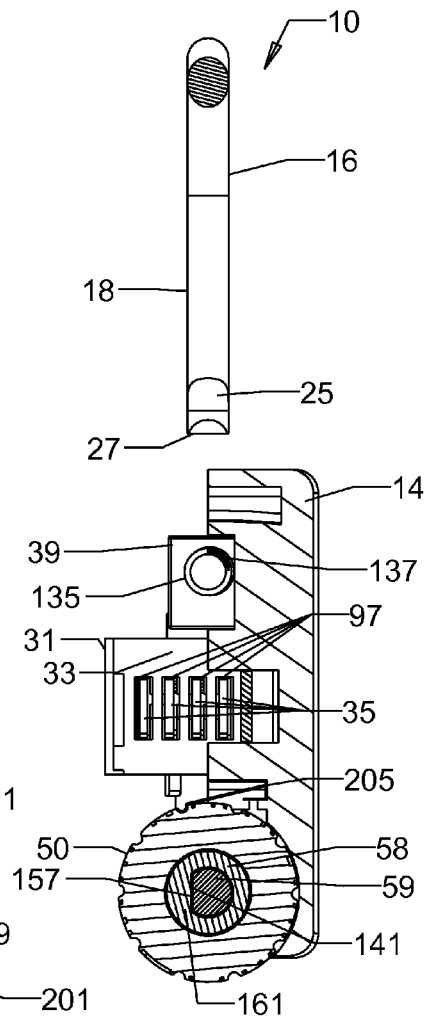
FIG 14B

PADLOCK WITH FULLY INTEGRATED DUAL LOCKING SYSTEM

CROSS-REFERENCE TO RELATED APPLICATIONS

This application claims priority to U.S. Provisional Appl. No. 61/676,611 filed Jul. 27, 2012, which is hereby incorporated by reference in its entirety.

TECHNICAL FIELD

The present invention relates to padlocks, in particular a padlock with a dual locking mechanism.

BACKGROUND OF THE INVENTION

Numerous padlock constructions have been developed and are widely employed to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence.

It has been found that many of these prior art padlocks are employed by individuals to secure their luggage or suitcases during travel. In this regard, in airplane travel, new regulations and requirements allow customs officers or transit security personnel to physically break any padlock in order to gain access to luggage which is deemed suspicious. Under these new security regulations, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any padlock which may be on the luggage.

With these new regulations presently implemented, all prior art systems which are incapable of being opened by inspectors and/or security personnel are subject to being physically broken, in order to gain access to any luggage which needs to be visually inspected. As a result, consumers are faced with the possibility that any like system employed to protect the contents of the suitcase can be physically removed by security personnel, leaving the luggage completely unprotected during the remainder of the trip.

In order to eliminate the possibility of having a padlock completely broken by security personnel, newer prior art padlocks have been constructed with two separate and independent locking systems formed in a single padlock, with both locking systems independently enabling a single shackle to be released and/or lockingly engaged. In this way, by employing either a key activation zone or a combination activation zone, the padlock can be opened. Furthermore, padlocks of this general construction employ key controlled constructions which are open using master keys which are in the possession of security personnel. In this way, security personnel are able to open these padlocks for inspecting the contents of the luggage, and then re-lock the padlock in place after the inspection has been completed.

SUMMARY OF THE INVENTION

Exemplary embodiments of the present invention are directed to a padlock with an improved design, that may include a button to allow a shackle of the padlock to be opened when at least one locking mechanism of the padlock is placed in an unlocked mode.

In accordance with the present invention an exemplary embodiment of the present invention is directed to a padlock that may include a lock housing, a shackle including a toe and a heel, where at least the heel of the shackle is retained within the lock housing, and the shackle is positionable between an closed position in which the toe is at least partially surrounded by the lock housing and an open position in which the toe is spaced away from the lock housing. The padlock may also include a latch positioned within the lock housing and configured to retain the shackle in the closed position, a combination locking mechanism operatively connected to the latch, and operable between a locked configuration and an unlocked configuration, and a key locking mechanism operatively connected to the latch, and operable between a locked orientation and an unlocked orientation.

According to the exemplary embodiment of the present invention, the combination locking mechanism is configured to release the latch from the shackle when in the unlocked configuration, the key locking mechanism is configured to release the latch from the shackle when in the unlocked orientation, and when the latch is released from the shackle, the shackle is positionable to the open position.

According to the exemplary embodiment of the present invention, the combination locking mechanism and key locking mechanism are configured to contact the latch at different parts of the latch in order to cause movement the latch, which can then allow the shackle to be released from the closed position.

According to the exemplary embodiment of the present invention, the padlock may also include a reset button configured to place the combination locking mechanism in a reset mode in which the combination for the combination locking mechanism can be reset or reconfigured when the combination locking mechanism is in the unlocked configuration.

According to the exemplary embodiment of the present invention, the shackle may include a locking zone formed within the toe, and the latch may include a locking extension configured for engagement with the locking zone of the shackle when the shackle is in the closed position, and the locking extension is configured to retain the shackle in the closed position.

According to the exemplary embodiment of the present invention, the padlock may also include a latch spring configured to bias the locking extension of the latch in a direction towards the locking zone of the toe so that the shackle is retained in the closed position.

According to the exemplary embodiment of the present invention, the combination locking mechanism may include at least one dial, at least one clutch operatively engaged with the at least one dial and having a passageway, a spindle positioned through the passageway of the at least one clutch, and a button configured for operative engagement with the spindle and the latch, and configured to release the latch from the shackle when the combination locking mechanism is in the unlocked configuration.

According to the exemplary embodiment of the present invention, the spindle is configured to restrict movement of button when the combination locking mechanism is in the locked configuration so that the button cannot release the latch from the shackle.

According to the exemplary embodiment of the present invention, the spindle may include at least one cylindrical blocking portion, each of the cylindrical blocking portions having a flat cut surface, each of the at least one clutches may include a locking surface positioned adjacent to the passageway, and each of the cylindrical blocking portions are configured for engagement with each of the passageways when all of the flat cut surfaces of each of the cylindrical blocking portions are aligned with all of the locking surfaces of each of the clutches.

According to the exemplary embodiment of the present invention, the spindle may include a locking structure formed at one end thereof, and the button may include a locking notch configured for operative engagement with the locking structure of the spindle, when the combination locking mechanism is in the locked configuration the locking structure is at least partially retained within the locking notch, and when the combination locking mechanism is in the unlocked configuration movement of the button removes the locking structure from the locking notch.

According to the exemplary embodiment of the present invention, the button may include a sloped side positioned at one end thereof, and the sloped side is configured for engagement with the latch such that engagement of the sloped side with the latch due to movement of the button causes movement of the latch in a direction substantially perpendicular to the movement of the button.

According to the exemplary embodiment of the present invention, the combination locking mechanism may also include a button spring configured to bias the button in a direction away from the latch, and a spindle spring configured to bias the spindle in a direction towards the button.

According to the exemplary embodiment of the present invention, the key locking mechanism may include a disc tumbler cylinder having a longitudinal axis and configured for receipt of a key, a cylinder housing at least partially surrounding the disc tumbler cylinder and including at least one opening formed therein, and at least one wafer plate positionable between an extended position in which at least part of the wafer plate is in the opening and a retracted position in which the wafer plate is not within the opening.

According to the exemplary embodiment of the present invention, the key is configured to move the at least one wafer plate between the extended position and the retracted position when inserted into the disc tumbler cylinder.

According to the exemplary embodiment of the present invention, the key locking mechanism is configuration for positioning in the unlocked orientation when all of the at least one wafer plates are in the retracted position.

According to the exemplary embodiment of the present invention, the key locking mechanism may also include a cam operatively connected to the disc tumbler cylinder, and the disc tumbler cylinder is configured for rotational movement about its longitudinal axis when all of the at least one wafer plates are in the retracted position.

According to the exemplary embodiment of the present invention, the cam is operatively connected to the disc tumbler cylinder so that rotational movement of the disc tumbler cylinder is transferred to the cam, and the cam may include an extended pusher configured for operative engagement with the latch.

According to the exemplary embodiment of the present invention, when the key locking mechanism is in the unlocked orientation the extended pusher is configured to move the latch in a direction away from the toe of the shackle so that the latch releases the shackle and the shackle is free to move into the open position.

Accordingly another exemplary embodiment of the present invention is directed to a padlock with a dual locking mechanism, where the padlock is enclosed in a locking body/housing. The padlock can be opened by a combination code locking mechanism and/or a key overriding mechanism. The combination code locking mechanism is controlled by at least one dial, which when all are turned to the preset lock-opened combination, cause openings of clutches associated with each dial to align with flat-cut surfaces of a spindle. The spindle is then allowed to move horizontally relative to a button when the button is pushed to release shackle out of the lock body/housing.

Accordingly another exemplary embodiment of the present invention is directed to a padlock including a body or housing of a body, having holes therein to receive a toe of a shackle and a heel of the shackle. The heel part of the shackle positioned inside of the lock body/housing so that the toe can move away from the body to a lock releasing position. The shackle is configured to be released from the body from a first position (the locked mode) to a second position (lock opened mode), a cam connected to a latch to control movement of the latch, the latch configured to block vertical movement of the shackle when a top-tip of the latch is engaged in a locking zone of the shackle.

According to the exemplary embodiment of the present invention, the padlock may also include a button positioned on the padlock so that a user can push it, the button configured to contact the latch to open the shackle so that a spindle is allowed to move when associated clutches and dials are in a lock open position; the spindle configured to be placed inside the dials and the clutches configured such that when the lock is in an opening combination, a flat-cut-surface of the spindle aligns with openings of the clutch and the spindle is able to move when the button is being pushed, and the cam configured to be turned when the user uses a correct key to turn a cylinder so that the cam pushes the latch and to open the padlock.

According to the exemplary embodiment of the present invention, the button has at least two slopes, one on top of the button and one at the bottom of the button so as to control the movement of the spindle and the latch, the spindle moves first when the button is initially being pushed and thereafter the latch is pushed so as to no longer be engaged with the shackle, and thereby to release a toe away from the padlock.

According to the exemplary embodiment of the present invention, the spindle has a slope which receives a slope on the button; wherein the spindle also has a surface to align with the opening of the clutch, so that if at least one clutch is not aligned with the spindle, the spindle is restricted from any movement and if the clutch opens and the surface of the spindle are all aligned with each other, then the button can push the spindle.

According to the exemplary embodiment of the present invention, the clutch has an opening to align with the surface of the spindle.

According to the exemplary embodiment of the present invention, the latch has at least two slopes, one slope to contact the button or any mechanism so as to raise the combination mechanism, and the other slope is the top-tip of the latch which is configured to lock the shackle when both the top-tip and a locking zone of the shackle are engaged together, the latch also has a wall for the cam or any key locking mechanism to contact so as to move the latch and to open the lock.

According to the exemplary embodiment of the present invention, the cam is configured to be turned when a correct key has been inserted into the cylinder to rotate the cylinder, the cam having an extended fork to contact the latch to open the lock in the key locking mechanism.

According to the exemplary embodiment of the present invention, the combination locking mechanism and key locking mechanism both can contact the latch in different parts to move the latch, which can then allow the shackle to be released from the locking position.

According to the exemplary embodiment of the present invention, the latch has dual slopes; one slope for engaging the shackle to lock the shackle inside the padlock, the other slope to let a combination locking mechanism such as button to contact and to move the latch and release the shackle away from the lock.

BRIEF DESCRIPTION OF THE DRAWINGS

For a fuller understanding of the nature and objects of the present invention, reference is made to the following detailed description taken in conjunction with the following drawings in which:

FIG. 2A is a front view of the exemplary embodiment of the padlock with a front body cover removed in order to show exemplary internal components thereof;

FIG. 2B is a side cross-sectional view of the exemplary embodiment of the padlock taken along line 2B-2B of FIG. 2A;

FIG. 14A is a front view of the exemplary embodiment of the padlock with a front body cover removed in order to show exemplary internal components thereof with the shackle in an open position;

FIG. 14B is a side cross-sectional view of the exemplary embodiment of the padlock taken along line 14B-14B of FIG. 14A;

DETAILED DESCRIPTION

Figure 1A:
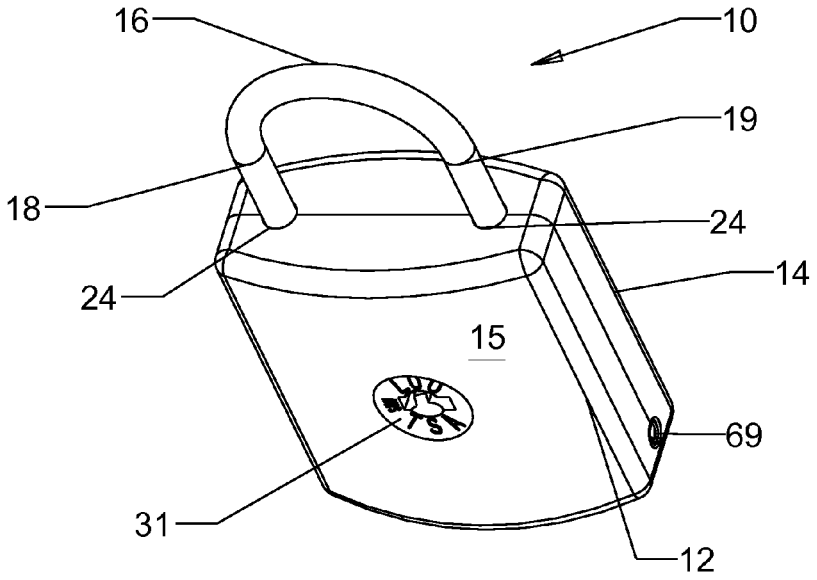
FIG. 1A is a top perspective view of an exemplary embodiment of a padlock according to the present invention.
Figure 1B:
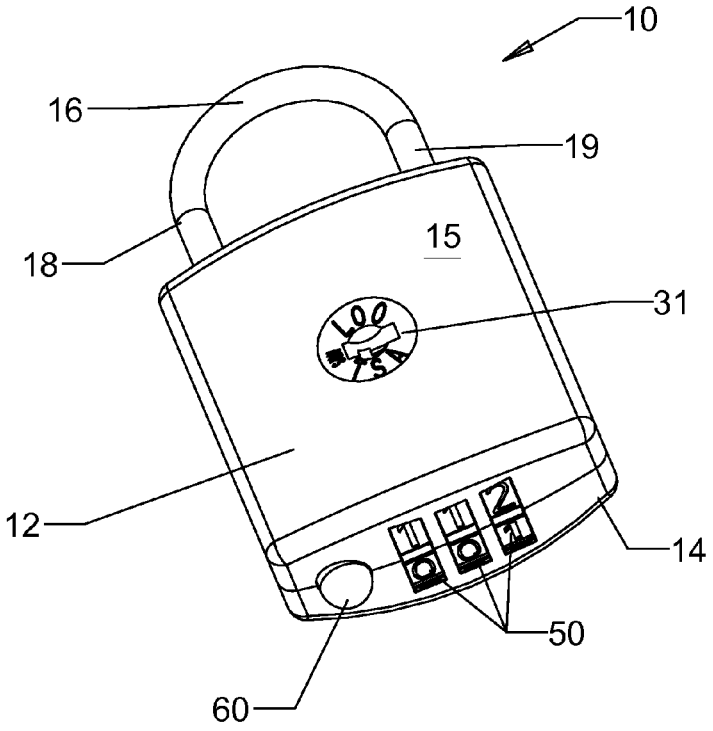
FIG. 1B is a bottom perspective view of the exemplary embodiment of the padlock according to the present invention.
Figure 2C:
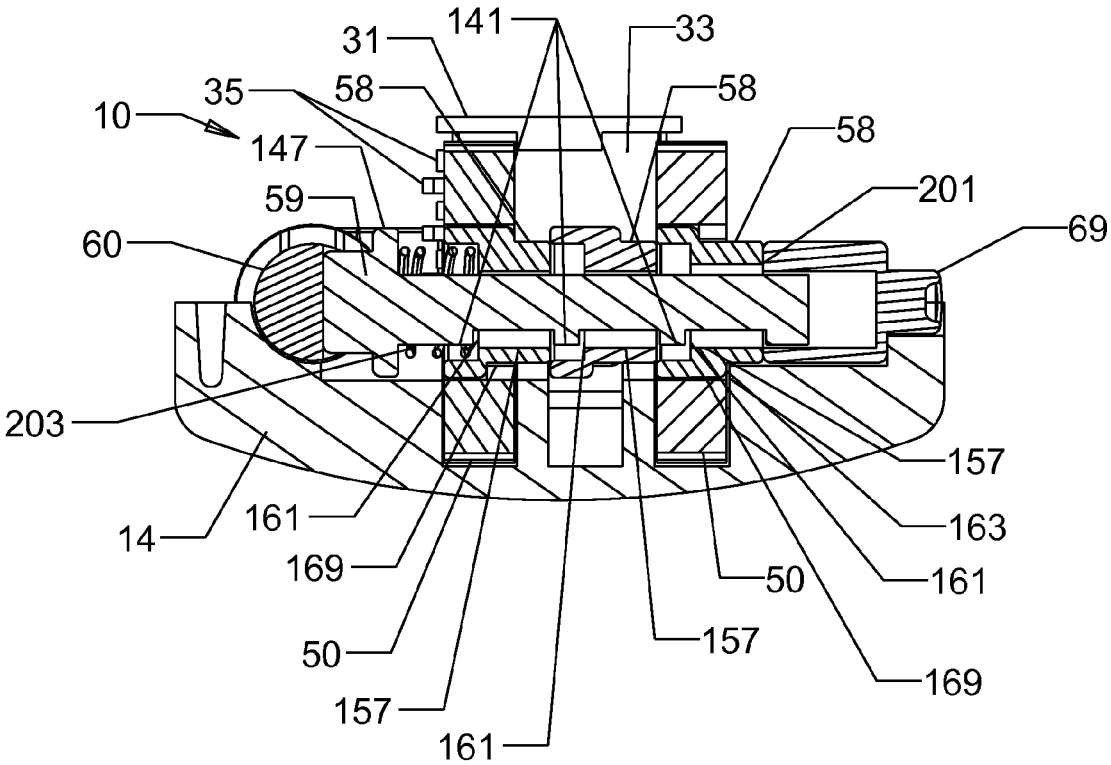
FIG. 2C is a cross-sectional view of the exemplary embodiment of the padlock taken along line 2C-2C of FIG. 2A.
Figure 3B:
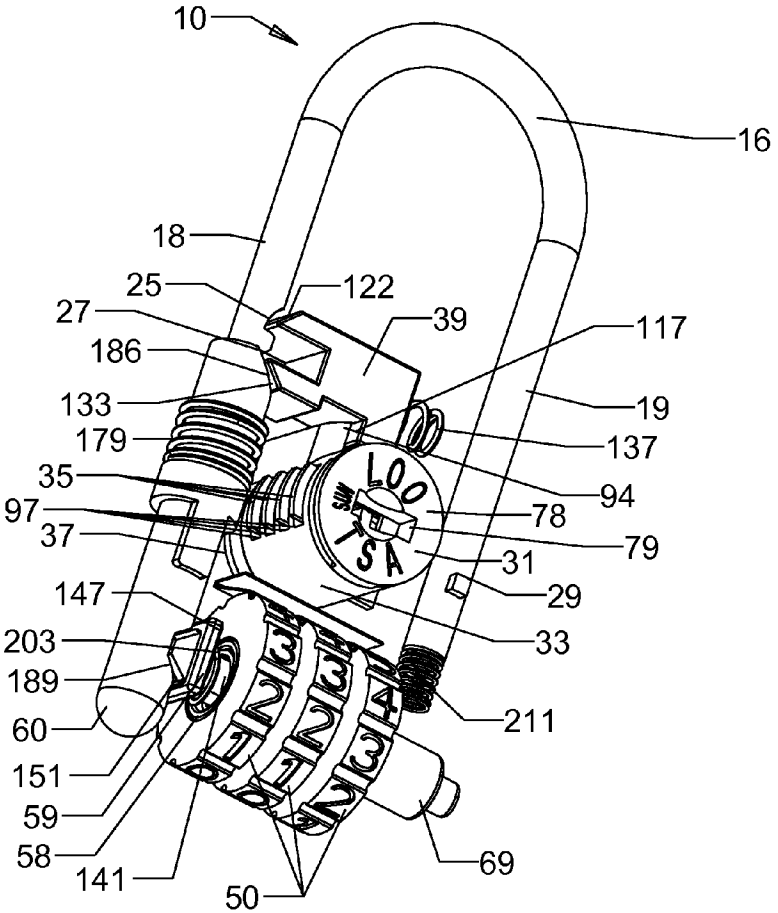
FIG. 3B is a perspective view of the exemplary embodiment of the padlock without the front body cover and a back body cover in order to show the exemplary internal components thereof.
Figure 3A:
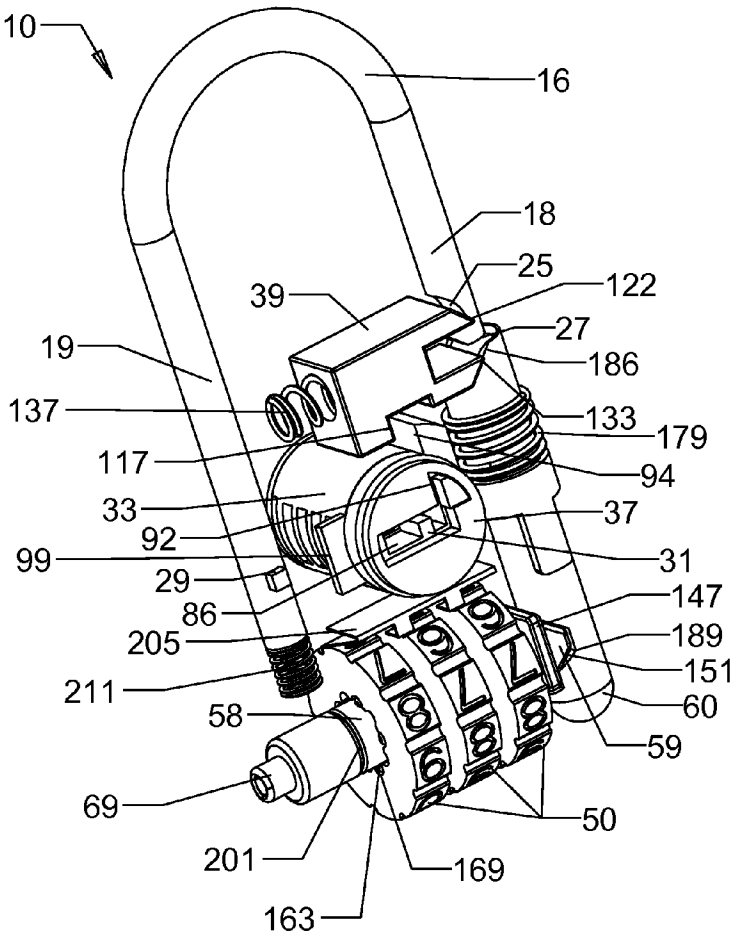
FIG. 3A is a perspective view of the exemplary embodiment of the padlock without the front body cover and a back body cover in order to show the exemplary internal components thereof.

The present invention now will be described more fully hereinafter with reference to the accompanying figures, in which exemplary embodiments of the invention are shown.

The invention may, however, be embodied in many different forms and should not be construed as limited to the embodiments set forth herein. Like reference numerals refer to like elements throughout.

Referring now to FIGS. 1A, 1B, 2A, and 2B, in which an exemplary embodiment of a padlock, generally indicated by reference numeral 10, according to the present invention is shown. The padlock 10 includes a front lock body 12 and a rear lock body 14, both of which are configured to contain at least some of the internal components of the padlock 10. The front lock body 12 and the rear lock body 14 are also configured to be joined together in order to form a lock housing 15 of the padlock 10. It is understood that while the front lock body 12 and rear lock body 14 are referred to as "front" and "rear," these terms are merely relative and do not limit the positioning of the padlock 10 to any particular orientation.

Figure 8:
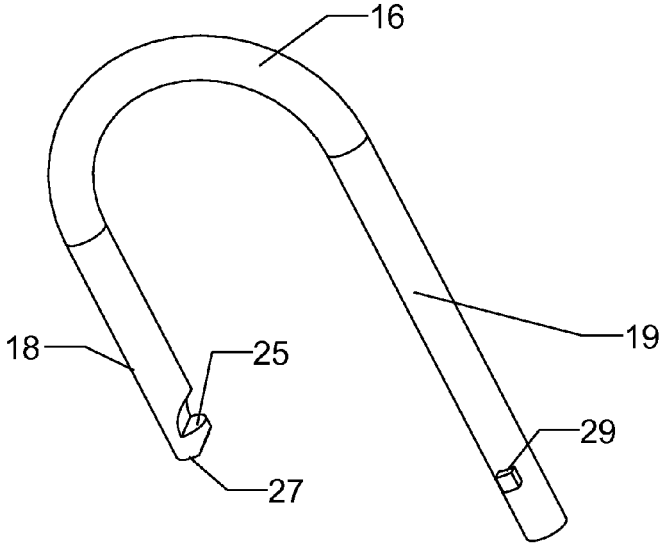
FIG. 8 is a perspective view of an exemplary embodiment of a shackle that may be used in the exemplary embodiment of the padlock according to the present invention.

Still referring to FIGS. 1A, 1B, 2A and 2B, the padlock 10 may also include a shackle 16 that includes a toe 18 and a heel 19. The shackle 16 may preferably be a J-shaped shackle, but it is understood that the shackle 16 may have any suitable configuration and/or shape in accordance with exemplary embodiments of the present invention. Each of the toe 18 and the heel 19 of the shackle 16 are dimensioned to fit through a shackle hole 24 formed in the lock housing 15 when the front lock body 12 and the rear lock body 14 are joined together. As additionally shown in FIG. 8, the toe 18 of the shackle 16 may include a locking zone 25 formed therein, as well as an at least partially beveled end 27 formed at one end of the toe 18. The heel 19 of the shackle 16 may include at least one extended protrusion 29 that is configured and positioned so as to prevent complete removal of the shackle 16 from the lock housing 15.

Referring again to FIGS. 1A, 1B, 2A and 2B, the padlock 10 also includes a key locking mechanism that includes a disc tumbler cylinder 31, a cylinder housing 33, at least one wafer plate 35, a cam 37 and a latch 39. The padlock 10 may also include a combination locking mechanism that includes at least one dial 50, at least one clutch 58 operatively connected to each of the at least one dials 50, a spindle 59, a button 60 and the latch 39. The padlock 10 may also include a combination reset button 69 that may be used to reset and/or reconfigure the code and/or combination that the dials 50 are set to in order to unlock the combination locking mechanism.

Figure 9A:
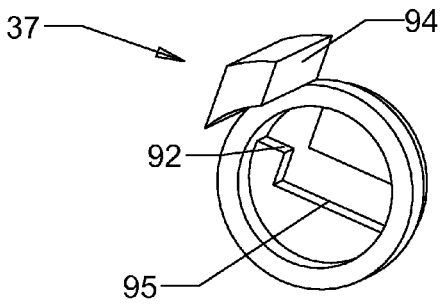
FIG. 9A is a rear perspective view of an exemplary embodiment of a cam that may be used in the exemplary embodiment of the padlock according to the present invention.
Figure 9B:
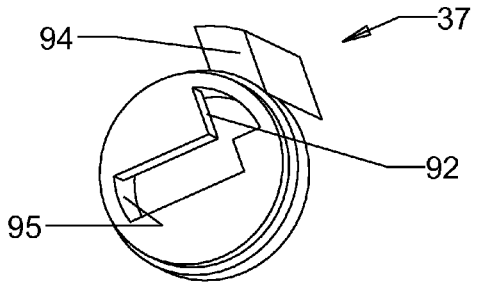
FIG. 9B is a front perspective view of the exemplary embodiment of the shackle that may be used in the exemplary embodiment of the padlock according to the present invention.
Figure 12:
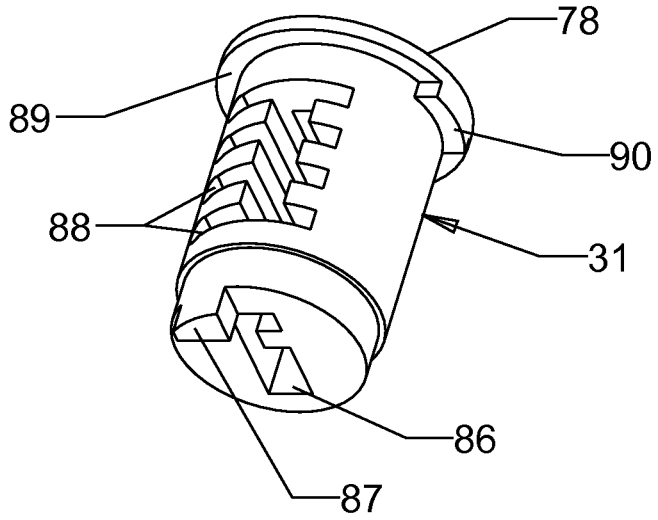
FIG. 12 is a perspective view of an exemplary embodiment of a lock cylinder that may be used in the exemplary embodiment of the padlock according to the present invention.

As shown in FIGS. 2A, 2B, 3A and 3B, the disc tumbler cylinder 31 of the key locking mechanism is configured and dimensioned to be inserted into the cylinder housing 33. The diameter of the disc tumbler cylinder 31 may be slightly less than the diameter of the cylinder housing 33 so as to permit rotation of the disc tumbler cylinder 31 along its longitudinal axis within the cylinder housing 33. One end of the disc tumbler cylinder 31 includes a substantially circular face 78 that includes a key aperture 79 formed therein, and the key aperture 79 is connected to a key channel 86 extending through the disc tumbler cylinder 31 substantially parallel to the longitudinal axis of the disc tumbler cylinder 31. The cam 37 of the key locking mechanism is engaged with the other end of the disc tumbler cylinder 31. As additionally shown by FIG. 12, the disc tumbler cylinder 31 includes an extended finger 87 that extends from this end of the disc tumbler cylinder 31 in order to engage with the cam 37. The disc tumbler cylinder 31 may also include at least one wafer slot 88 formed therein, and positioned substantially perpendicular to the key channel 86. The substantially circular face 78 of the disc tumbler cylinder 31 may include a flange 89 and a tab 90 extending from the flange 89. As additionally shown in FIGS. 9A and 9B, the cam 37 may include a slot 92 dimensioned to receive the extended finger 87 of the disc tumbler cylinder 31 so that rotational movement of the disc tumbler cylinder 31 may be transferred to the cam 37. The cam 37 may also include an extended pusher 94 projecting outwardly there from. The cam 37 may also include an opening 95 that may be positioned for alignment with the key channel 86 of the disc tumbler cylinder 31 when the slot 92 is engaged with the extended finger 87.

Figure 13:
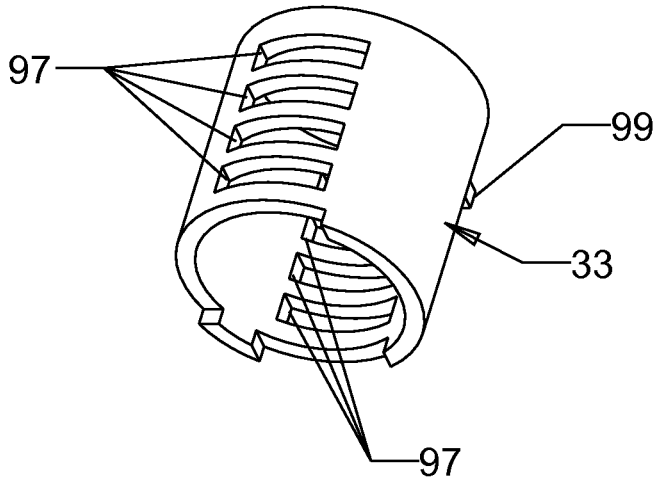
FIG. 13 is a perspective view of an exemplary embodiment of a lock cylinder housing that may be used in the exemplary embodiment of the padlock according to the present invention.

Referring again to FIGS. 2A, 2B, 3A and 3B, each of the wafer slots 88 are dimensioned to have a wafer plate 35 positioned therein. When the correct key (not shown) for the key locking mechanism has not been inserted into the key aperture 79 and key channel 86 each of the wafer plates 35 extend from the wafer slots 88, and engage with the cylinder housing 33 so that the disc tumbler cylinder 31 cannot be rotated. It is understood that while wafer plates 35 are shown in this exemplary embodiment of the present invention other lock components, such as pins, may also be used with the key locking mechanism in order to prevent rotation of the disc tumbler cylinder. As additionally shown in FIG. 13, the cylinder housing 33 includes at least one wafer opening 97 that is dimensioned to receive the wafer plates 35 when the wafer plates 35 extend from the wafer slots 88 of the disc tumbler cylinder 31. The cylinder housing 33 may also include a rectangular tab 99 that is configured to limit and/or prohibit rotation of the cylinder housing 33 within the lock housing 15. Referring again to FIGS. 2A and 2B, the rear lock body 14 of the lock housing 15 may include a recessed area 107 that is dimensioned to receive the rectangular tab 99, and prevent arcuate movement of the rectangular tab 99 so that the position and/or orientation of the cylinder housing 33 within the lock housing 15 is maintained. The lock housing 15 may also include one or more wafer cavities 109 formed in the front lock body 12 and/or rear lock body 14 so that the wafer plates 35 may extend past the cylinder housing 33, and in order to provide additional security and/or durability to prevent rotation of the cylinder housing 33 and/or disc tumbler cylinder 31 without the use of the correct key (not shown).

Figure 7A:
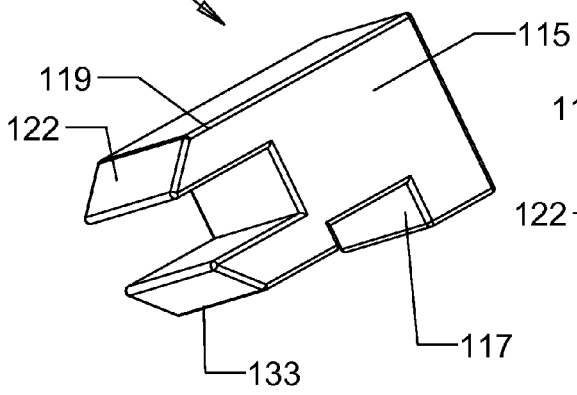
FIG. 7A is a side perspective view of an exemplary embodiment of a latch that may be used in the exemplary embodiment of the padlock according to the present invention.
Figure 7B:
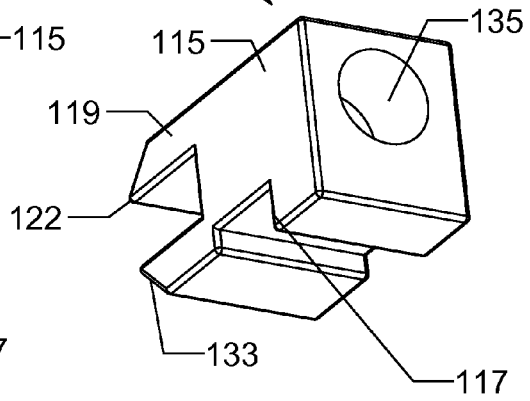
FIG. 7B is a rear perspective view of the exemplary embodiment of the latch that may be used in the exemplary embodiment of the padlock according to the present invention.

Referring again to FIGS. 2A, 2B, 3A and 3B, the extended pusher 94 of the cam 37 of the key locking mechanism of the padlock 10 is positioned so as to be operatively coupled to the latch 39 in order to cause movement of the latch 39 in a direction away from the toe 18 of the shackle 16. As additionally shown in FIGS. 7A and 7B, the latch 39 includes a body portion 115 and an extended shoulder 117 extending from the body portion 115, and positioned for operative engagement with the extended pusher 94 of the cam 37. The latch 39 also includes a locking extension 119 also extending from the body portion 115, and positioned so as to operatively engage with the locking zone 25 of the toe 18 of the shackle 16. The locking extension 119 may also include a sloped tip 122, and the latch 39 may also include a lower extension 129. The lower extension 129 may also include a sloped tip 133. The latch 39 may also have a spring cavity 135 formed in the body portion 115. The spring cavity 135 is dimensioned to receive a latch spring 137 that is configured to urge the latch in a direction towards the toe 18 of the shackle 16.

As further discussed below, the key locking mechanism has a locked orientation and an unlocked orientation. In the locked orientation, which is shown for example in FIGS. 2A, 2B, 3A and 3B, at least one wafer plate 35 extends through the wafer openings 97 of the cylinder housing 33 thereby preventing rotational movement of the disc tumbler cylinder 31. As a result, the extended pusher 94 of the cam 37 is spaced apart from the extended shoulder 117 of the latch 39, thereby allowing the latch spring 137 to be extended and urge the latch 39 in a direction towards the toe 18 of the shackle 16 so that the locking extension 119 may be engaged with the locking zone 25 of the toe 18 of the shackle 16. In the unlocked orientation, a correct cut key (not shown) has been inserted into the disc tumbler cylinder 31, which causes retraction of the wafer plates 35 from the wafer openings 97, thereby permitting rotational movement of the disc tumbler cylinder 31. This rotational movement in turn causes rotation of the cam 37, which results in the extended pusher 94 contacting the extended shoulder 117 and movement of the latch 39 away from the toe 18 of the shackle 16. As the latch 39 moves in a direction away from the toe 18, the locking extension 119 is no longer engaged with the locking zone 25, and the shackle 16 is now free to move from the closed position, as shown for example in FIG. 2A, to an open position.

Figure 4A:
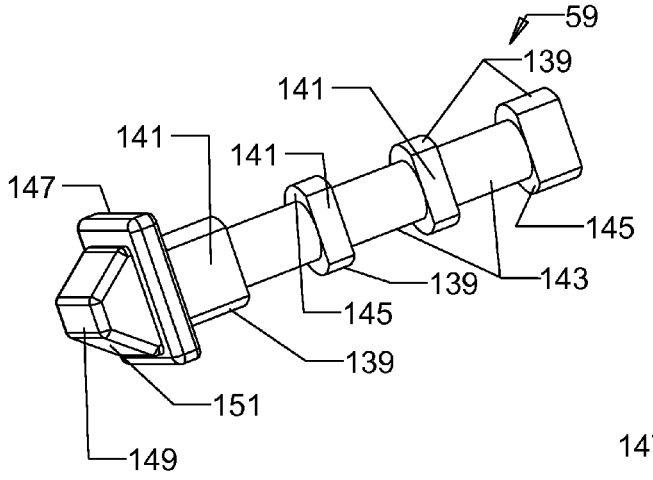
FIG. 4A is a side perspective view of an exemplary embodiment of a spindle that may be used in the exemplary embodiment of the padlock according to the present invention.
Figure 4B:
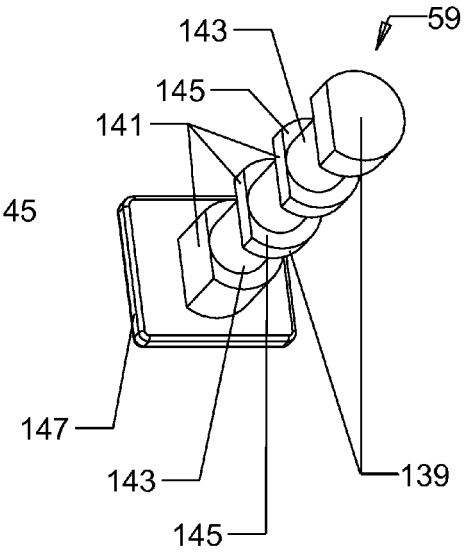
FIG. 4B is a rear perspective view of the exemplary embodiment of the spindle that may be used in the exemplary embodiment of the padlock according to the present invention.

Referring now to FIGS. 2A, 2B, 2C, 3A and 3B, the combination locking mechanism of the padlock 10 includes at least one dial 50, where each dial 50 is operatively engaged with the clutch 58, and each clutch 58 is positioned for rotational movement about the spindle 59. As additionally shown in FIGS. 4A and 4B, the spindle 59 includes at least one cylindrical blocking portion 139, and each cylindrical blocking portion 139 includes a flat cut surface 141. The spindle 59 may also include a cylindrical body section 143 positioned between pairs of cylindrical blocking portions 139. In general, the cylindrical body sections 143 may have smaller diameters than the diameters of the cylindrical blocking portions 139. In this manner, the spindle 59 may include a plurality of surfaces 145 are positioned on the cylindrical blocking portions 139 substantially perpendicular to the cylindrical body sections 143. It is understood that the flat cut surfaces 141 may lie on a same plane as a point of the cylindrical body section 143 so that no surface is formed adjacent to the flat cut surfaces 141 and so that the flat cut surfaces 141 does not extend above the cylindrical body sections 143. At one end of the spindle 59 is positioned a square shaped block 147 that is configured to fit into a cutout portion of the lock housing 15 in order to restrict and/or prevent rotational movement of the spindle 59. The spindle 59 may also include a locking structure 149 extending from a side of the square shaped block 147 opposite the side from which the cylindrical blocking portions 139 and cylindrical body sections 143 extend from. The locking structure 149 may include at least one sloped face 151.

Figure 10A:
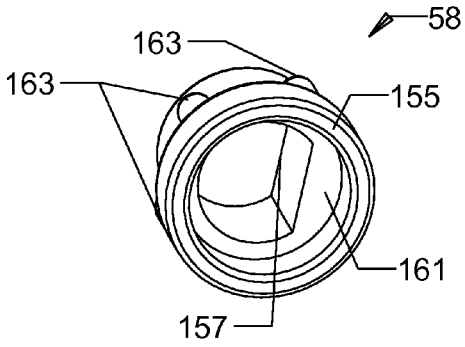
FIG. 10A is a front perspective view of an exemplary embodiment of a clutch that may be used in the exemplary embodiment of the padlock according to the present invention.
Figure 10B:
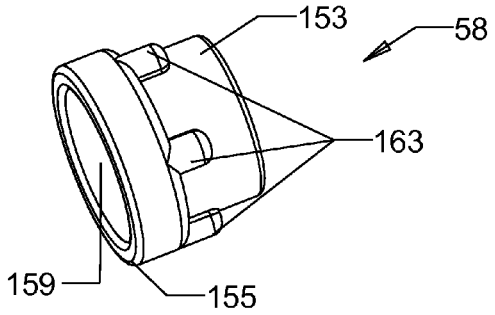
FIG. 10B is a side perspective view of the exemplary embodiment of the shackle that may be used in the exemplary embodiment of the padlock according to the present invention.
Figure 10C:
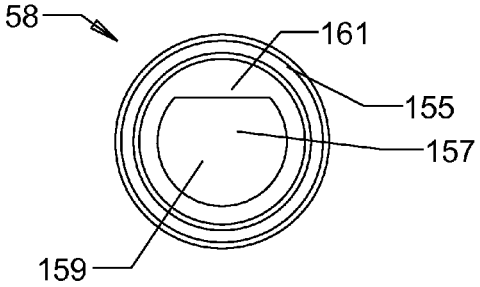
FIG. 10C is a front view of the exemplary embodiment of the shackle that may be used in the exemplary embodiment of the padlock according to the present invention.

Referring again to FIGS. 2A, 2B, 2C, 3A and 3B, the combination locking mechanism also includes at least one clutch 58 positioned around the spindle 59, and configured for rotational operation around the spindle 59. The at least one clutch 58 may also be configured for movement along a longitudinal axis of the spindle 59 in order to permit resetting and/or reconfiguring of the combination for the combination locking mechanism, as will be discussed further below. As additionally shown in FIGS. 10A, 10B and 10C, each of the clutches 58 includes a cylindrical body portion 153 and a circular ring portion 155 extending from an end of the cylindrical body portion 153. The cylindrical body portion 153 includes a passageway 157 that may have a cross-section that is substantially the shape of a segment of a circle. The circular ring portion 155 has a substantially circular opening 159, and positioned between the passageway 157 of the cylindrical body portion 153 and the substantially circular opening 159 is a locking surface 161. The clutch 58 may also include at least one extended fin 163 extending from the circular ring portion 155 and positioned on an outer surface of the cylindrical body portion 153.

Figure 5:
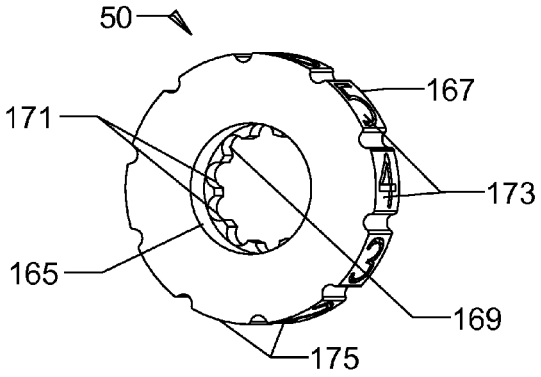
FIG. 5 is a perspective view of an exemplary embodiment of a dial used that may be used in the exemplary embodiment of the padlock according to the present invention.

Referring again to FIGS. 2A, 2B, 2C, 3A and 3B, the combination locking mechanism of the padlock 10 may also include at least one dial 50 operatively engaged with each of the clutches 58. The dial 50 is operatively engaged with the clutch 58 so that rotational movement of the dial 50 may be transferred to the clutch 58, when the dial 50 is engaged with the clutch 58. Accordingly, the dial 50 is positioned for rotational operation around the spindle 59. As additionally shown in FIG. 5, each dial 50 includes an inside surface 165 and an outside surface 167. The inside surface 165 may have a diameter slightly greater than the diameter of the cylindrical body portion 153 of the clutch 58. Extending from the inside surface 165 towards the center of the dial 50 are a plurality of teeth 169 that define a plurality of grooves 171, where each groove 171 is formed between a pair of the plurality of teeth 169. Each groove 171 may be configured and dimensioned to receive and retain an extended fin 163 of the clutch 58 so that when the extended fin 163 is received and retained within the groove 171, the clutch 58 and the dial 50 are in interlocked engagement permitting both the clutch 58 and the dial 50 to be configured to rotate about the longitudinal axis of the spindle 59. The dial 50 may also include one or more indicia 173 formed on the outside surface 167 thereof. Each of the indicia 173 represent one component of the combination that may be used to position the clutches 58 in the required location for placing the combination locking mechanism in an unlocked configuration, as will be discussed further below. It is understood that the indicia 173 may be any symbol, color, design, character or other mark, and may be for example alpha numeric characters. Each indicia 173 may be disposed on and/or formed on or in a separate face 175 positioned around the outside surface 167 of the dial 50. Each face 175 may be separated from adjacent faces 175 by channels 177 formed on the outside surface 167 of the dial 50.

Figure 6:
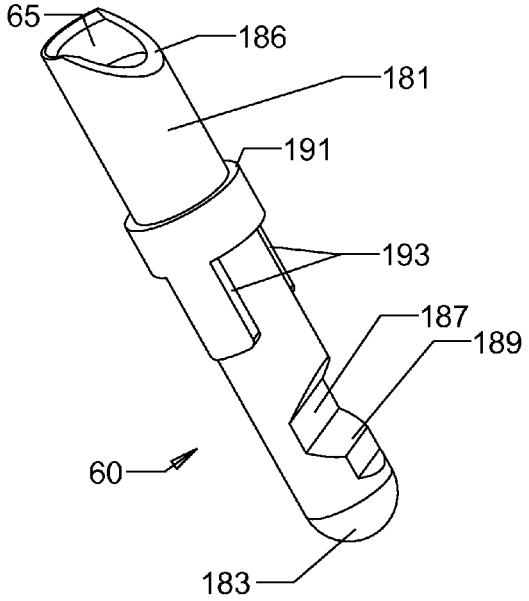
FIG. 6 is a perspective view of an exemplary embodiment of a button that may be used in the exemplary embodiment of the padlock according to the present invention.

Referring again to FIGS. 2A, 2B, 2C, 3A and 3B, the combination locking mechanism also includes the button 60 that is operatively engaged with the spindle 59, and configured to cause the latch 39 to release the shackle 16. The button 60 may be positioned within the lock housing 15 for operational movement substantially perpendicular to the longitudinal axis of the spindle 59. The button 60 is engaged with a button spring 179 that is configured to urge the button 60 in a direction away from the toe 18 of the shackle 16. As additionally shown in FIG. 6, the button 60 includes an elongated columnar body 181 with a semi-spherical knob 183 at one end and a chamber 185 positioned within the other end of the elongated columnar body 181. The button 60 may have at least a portion of the wall of the chamber 185 cut away to form an angled edge 186 of the elongated columnar body 181. The button 60 may also include a locking notch 187 formed in the elongated columnar body 181, and has at least one sloped side 189. The locking notch 187 is configured to engage with the locking structure 149 of the spindle 59. The button 60 may also include a spring seat ring 191 extending around the elongated columnar body 181 in order to provide a surface on which the button spring 179 may engage with the button 60. The spring seat ring 191 may also act in cooperation with formations within the lock housing 15 in order to prevent the button 60 from falling out of or being removed from the lock housing 15. The button 60 may also include at least one aligning rib 193 positioned on the elongated columnar body 181 in order to assist in maintaining the correct alignment of the button 60 within the lock housing 15.

Figure 11:
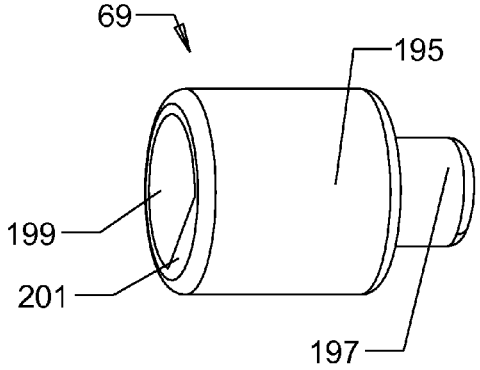
FIG. 11 is a perspective view of an exemplary embodiment of a reset button that may be used in the exemplary embodiment of the padlock according to the present invention.

Referring again to FIGS. 2A, 2B, 2C, 3A and 3B, the at least one clutch 58 of the combination locking mechanism may be engaged with the reset button 69 that may be configured to disengage each of the at least one clutches 58 from the corresponding dials 50. In this manner, the reset button 69 may be used, as discussed further below, to reset and/or reconfigure the code and/or combination that may be used to place the combination locking mechanism in the unlocked configuration. As additionally shown in FIG. 11, the reset button 69 includes a barrel body portion 195 and a cylindrical nub 197 extending from one side of the barrel body portion 195 and positioned substantially concentrically with the barrel body portion 195. A spindle chamber 199 is formed within the barrel body portion 195 of the reset button 69, and the spindle chamber 199 has a size and shape that is configured to receive at least one of the cylindrical blocking portions 139 of the spindle 59. The spindle chamber 199 may be substantially circular, with a segment of the circular formation being filled in by a solid end 201 of the reset button 69. The solid end 201 of the reset button 69 is configured to operatively contact the at least one clutch 58, so that when the reset button 69 is urged in a direction towards the spindle 59 the at least one clutch 58 may be moved in a direction along the longitudinal axis of the spindle 59.

Referring again to FIGS. 2A, 2B, 2C, 3A and 3B, the padlock may also include a spindle spring 203 disposed between one of the clutches 58 and the square shaped block 147 of the spindle 59. The spindle spring 203 is configured to urge the at least one clutch 58 and the spindle 59 in opposite directions along the longitudinal axis of the spindle 59 so that the spindle 59 will be urged towards the button 60, and the at least one clutch 58 will be urged towards the reset button 69. In this manner, the spindle 59 may be urged into an engaged relationship with the button 60, while the at least one clutch 58 may be urged into an engaged relationship with the reset button 69. The padlock 10 may also include a spring plate 205 disposed within the lock housing 15 and configured for operative engagement with the dials 50. The spring plate 205 is configured to engage with the channels 177 formed in the dial 50, so that at least some resistance is provided to limit free rotation of the dials 50. The spring plate 205 may be removed from the channels 177 of the dial 50 whenever the dial 50 is rotated, and then come to rest within another channel 177 in order to provide a physical and/or auditory indication that a particular face 175 displaying a desired indicia 173 has been selected for the dial 50. In this manner, it can be determined which indicia 173 have been selected for each dial 50 for entering the code and/or combination for the combination locking mechanism.

Referring now to FIG. 2A, the padlock 10 may also include a disc-shaped cavity 207 formed in the lock housing 15, and positioned around the heel 19 of the shackle 16. The disc-shaped cavity 207 may include a wall 209 extending towards the heel 19 of the shackle 16, and positioned substantially perpendicular to the heel 19. The disc-shaped cavity 207 is dimensioned so that the at least one extended protrusion 29 of the shackle 16 may be received within the disc-shaped cavity 207 and be permitted to move within the disc-shaped cavity 207 as the shackle 16 is rotated about the heel 19. However, it is understood that the wall 209 is positioned sufficiently close to the heel 19 of the shackle 16 so that the at least one extended protrusion 29 cannot be moved past the disc-shaped cavity 207. In this manner, it is understood that when the shackle 16 is in an open position, the shackle 16 may be permitted to rotate about the heel 19 within the lock housing 15, but may not be removed from the lock housing 15. The padlock 10 may also include a shackle spring 211 that is configured to urge the shackle 16 in a direction substantially perpendicular to the movement of the latch 39. The shackle spring 211 is configured to urge the shackle 16 so as to maintain tension between the toe 18 of the shackle 16 and the latch 39, and may also be configured to urge the shackle 16 away from the lock housing 15 when the latch 39 is no longer engaged with the toe 18 of the shackle 16.

Referring now to FIGS. 1A, 1B, 2A, 2B, 2C, 3A, 3B, 14A, 14B, 14C, 15A, 15B 16, 17A and 17B, the operation and use of the padlock 10 according to the present invention will now be discussed. It is understood that the shackle 16 of the padlock 10 is positionable between a closed position, as shown for example in FIGS. 1A, 1B, 2A, 2B, 3A, 3B and 15A, and an open position, as shown for example in FIGS. 14A, 14B, 16, 17A and 17B. In the closed position, the toe 18 of the shackle 16 is at least partially surrounded by the lock housing 15 of the padlock 10. As a result, the toe 18 may be positioned at least partially within the lock housing 15, thereby preventing rotation of the shackle 16 about the heel 19. In the open position of the shackle 16, the toe 18 has been removed from the lock housing 15, and as a result, the shackle 16 may be permitted to rotate about the heel 19.

Figure 15A:
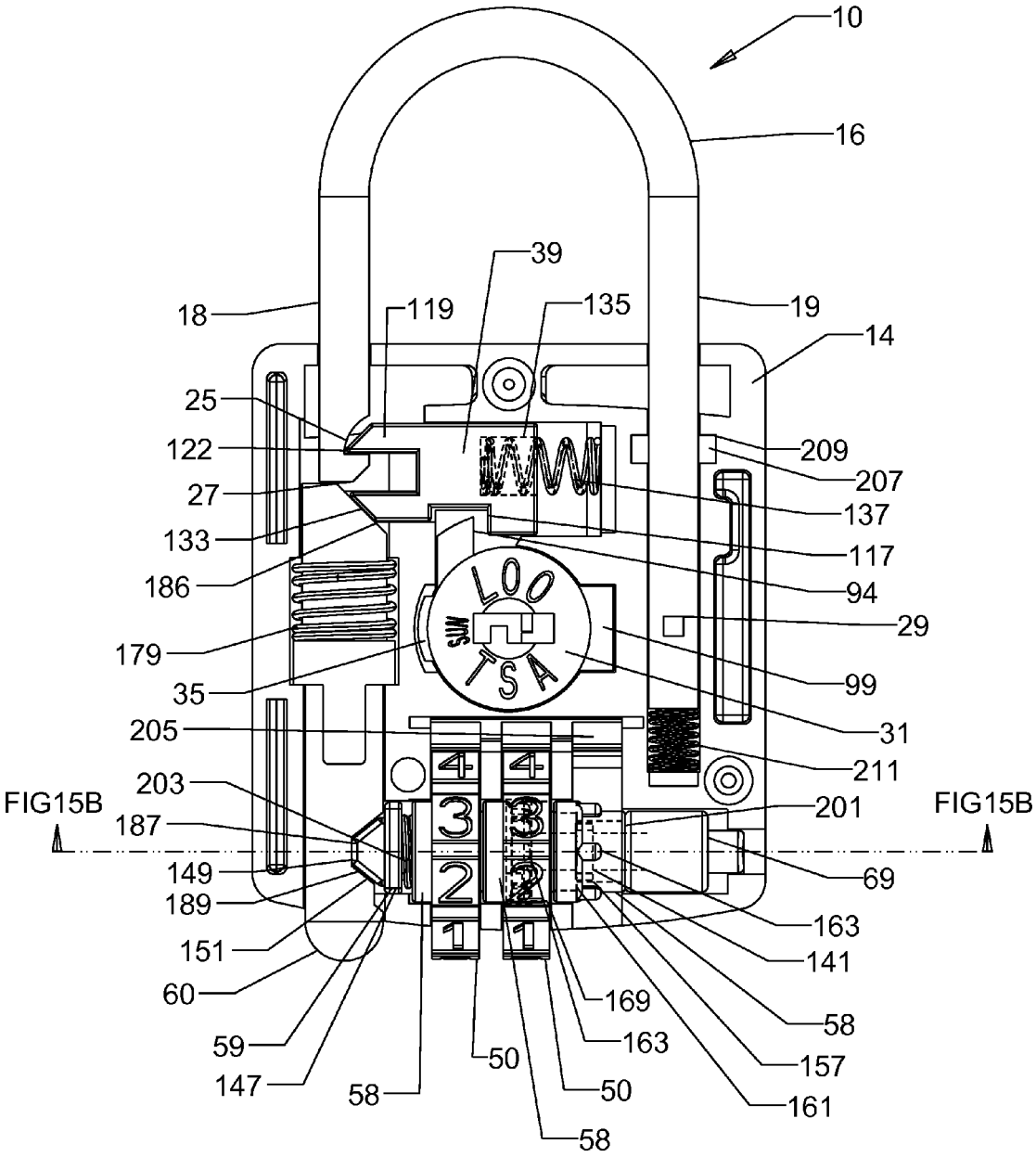
FIG. 15A is a front view of the exemplary embodiment of the padlock with a front body cover removed in order to show exemplary internal components thereof when the padlock is in a reset configuration.
Figure 16:
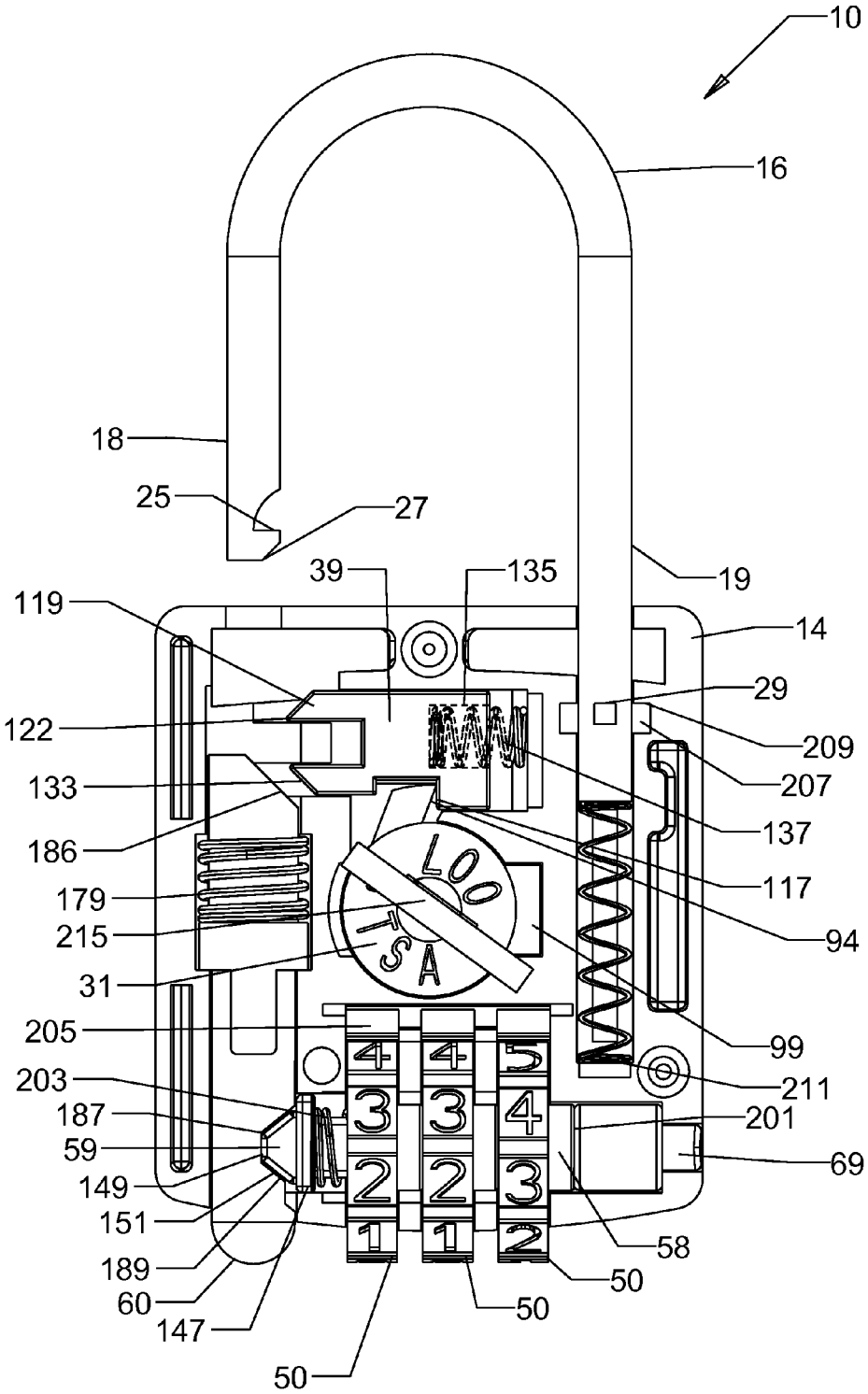
FIG. 16 is a front view of the exemplary embodiment of the padlock with a front body cover removed in order to show exemplary internal components thereof with the shackle in the open position.
Figure 17B:
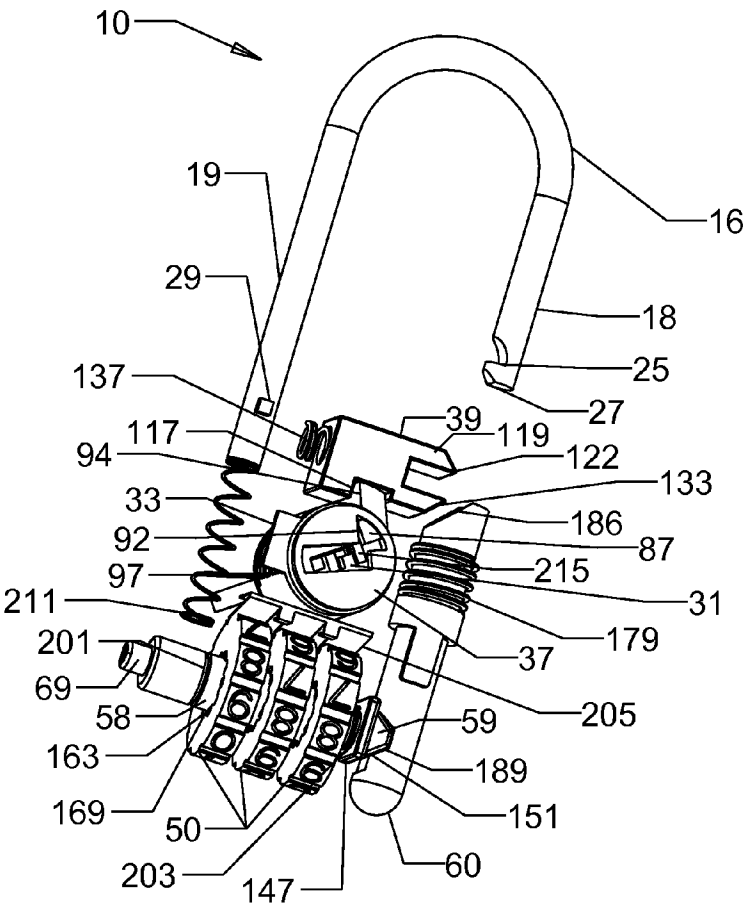
FIG. 17B is a rear perspective view of the exemplary embodiment of the padlock without the front body cover and the back body cover in order to show the exemplary internal components thereof with the shackle in the open position.
Figure 17A:
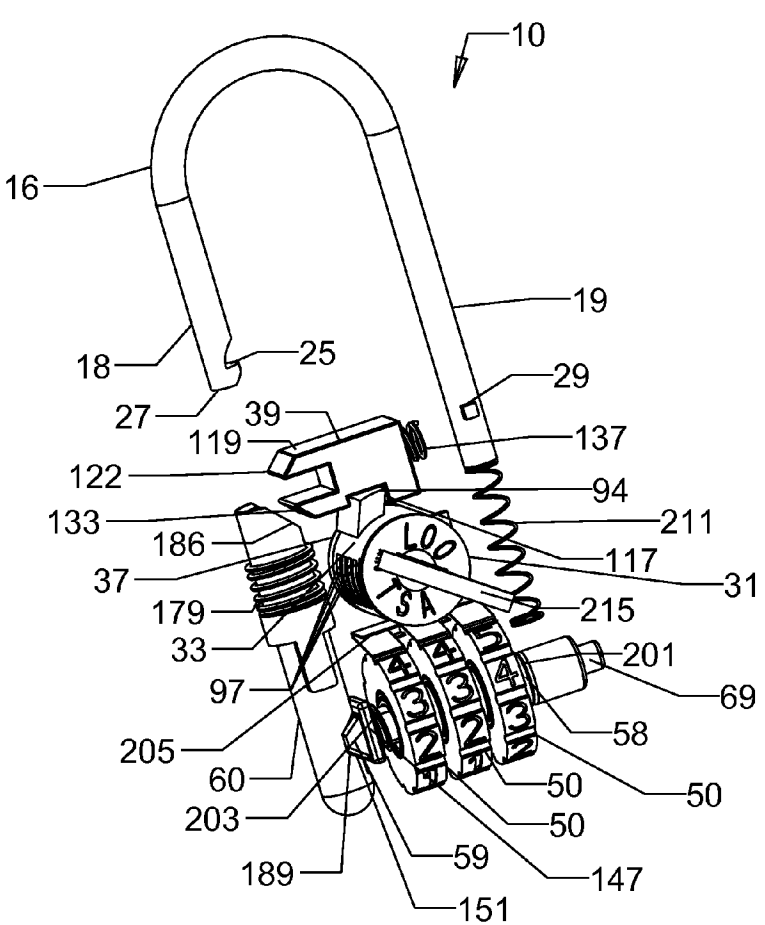
FIG. 17A is a front perspective view of the exemplary embodiment of the padlock without the front body cover and the back body cover in order to show the exemplary internal components thereof with the shackle in the open position.

It is further understood that the key locking mechanism is operable between the locked orientation, as shown for example in FIGS. 2A, 2B, 3A, 3B and 15A, and the unlocked orientation, as shown for example in FIGS. 16, 17A and 17B. In the locked orientation, a correct cut key 215, as seen for example in FIGS. 16, 17A and 17B, has not been inserted into the key channel 86 of the disc tumbler cylinder 31, and as a result the wafer plates 35 prevent rotational movement of the disc tumbler cylinder 31. It is also understood that the key locking mechanism may be in the locked orientation as a result of an incorrect cut key (not shown) or no key being inserted into the key channel 86 of the disc tumbler cylinder 31, since it is understood that the correct cut key 215 engages with the wafer plates 35. As shown for example in FIGS. 3A and 3B, the wafer plates 35 prevent rotational movement of the disc tumbler cylinder 31 by extending through at least one of the wafer openings 97 of the cylinder housing 33. Since at least one of the wafer plates 35 prevent rotation of the disc tumbler cylinder 31, rotation of the cam 37 is also prevented, thereby inhibiting arcuate movement of the extended pusher 94, so that the latch 39 remains engaged with the locking zone 25 of the toe 18 of the shackle 16.

As shown for example in FIG. 2A, in the locked orientation of the key locking mechanism the extended pusher 94 is spaced apart from the extended shoulder 117 of the latch 39, and as a result the latch spring 137 biases the latch 39 towards the toe 18 of the shackle 16. Therefore, in the locked orientation of the key locking mechanism the locking extension 119 of the latch 39 can remain engaged with the locking zone 25 of the shackle 16, and the shackle 16 may be retained in its closed position.

As shown for example in FIGS. 16, 17A and 17B, in the unlocked orientation of the key locking mechanism, the correct cut key 215 has been inserted into the key channel 86 of the disc tumbler cylinder 31, and as a result the wafer plates 35 no longer extend out of the wafer openings 97 of the cylinder housing 33. Since none of the wafer plates 35 extend from the wafer slots 88 and through the wafer openings 97 of the cylinder housing 33, the disc tumbler cylinder 31 may rotate within the cylinder housing 33. This rotational movement of the disc tumbler cylinder 31 is transferred to the cam 37, which results in arcuate movement of the extended pusher 94. The rotational movement of the disc tumbler cylinder 31 is transferred to the cam 37 through the extended finger 87 which is placed inside of the slot 92 of the cam 37, and as a result any rotational movement made by the disc tumbler cylinder 31 may be transferred to cam 37. As the extended pusher 94 moves it contacts the extended shoulder 117 of the latch 39, thereby pushing the latch 39 in a direction away from the toe 18 of the shackle 16. The extended pusher 94 acts on the latch 39 in order to compress the latch spring 137, which results in disengagement of the locking extension 119 from the locking zone 25 of the toe 18 of the shackle 16, as shown for example in FIGS. 16, 17A and 17B. As a result, the shackle 16 may be moved into the open position through the action of the shackle spring 211 urging the shackle 16 away from the lock housing 15. However, it is understood that the shackle 16 may remain in the closed position even if the key locking mechanism is placed in the unlocked orientation, since the shackle 16 may be kept within the lock housing 15 even if the latch 39 is disengaged from the toe 18.

In order to place the key locking mechanism back into the locked orientation and/or the shackle 16 back into the closed position, the correct cut key 215 may be rotated so that the extended pusher 94 of the cam 37 is moved away from the extended shoulder 117 of the latch 39. For example, as shown in FIGS. 16, 17A and 17B, counter-clockwise rotation of the correct cut key 215 will result in movement of the extended pusher 94 away from the extended shoulder 117 so that the latch spring 137 urges the latch 39 in a direction towards the button 60. Once the correct cut key 215 has been rotated so that the extended pusher 94 is no longer engaged with the latch 39, the correct cut key 215 may be removed from the disc tumbler cylinder 31 in order to place the key locking mechanism back into the locked orientation as a result of at least one of the wafer plates 35 extending through the wafer openings 97 of the cylinder housing 33. Once the key locking mechanism has been placed in the locked orientation, the shackle 16 may be urged in a direction towards the lock housing 15 so that the toe 18 of the shackle 16 is inserted back into the lock housing 15. As the shackle 16 is continued to be urged towards the lock housing 15, the beveled end 27 of the shackle 16 will contact the sloped tip 122 of the latch 39 urging the latch 39 in a direction away from the toe 18 of the shackle 16 and allowing the locking extension 119 to ultimately engage with the locking zone 25 of the shackle 16. In this manner, the key locking mechanism has been used to place and retain the shackle 16 back into the closed position of the shackle 16.

Figure 14C:
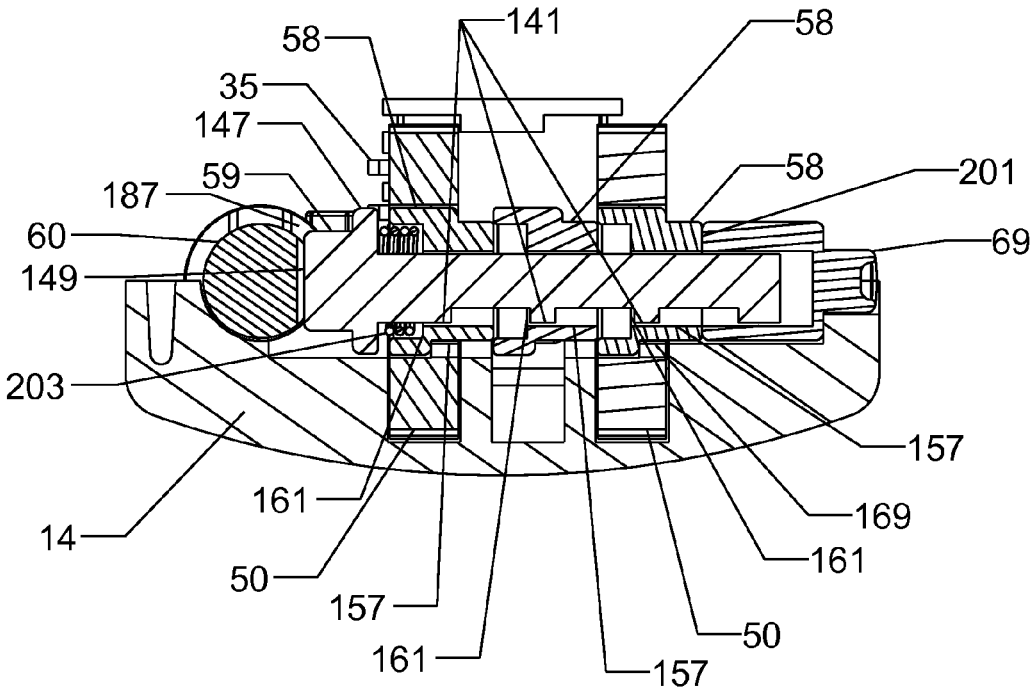
FIG. 14C is a cross-sectional view of the exemplary embodiment of the padlock taken along line 14C-14C of FIG. 14A.

It is also understood that the combination locking mechanism is operable between a locked configuration, as shown for example in FIGS. 2A, 2B, 2C, 3A and 3B, and an unlocked configuration, as shown for example in FIGS. 14A, 14B and 14C. In the locked configuration of the combination locking mechanism, at least one correct indicia 173 of the code and/or combination for the combination locking mechanism has not been set on at least one of the dials 50. It is understood that the code and/or combination for the combination locking mechanism is comprised of a set of indicia 173, so that when the correct indicia 173 have been set on the dials 50, the code and/or combination for the combination locking mechanism has been set. When at least one correct indicia 173 has not been set on the dials 50, the passageway 157 for each clutch 58 associated with a dial 50 that has not been set to the correct indicia 173 is not aligned with the adjacent cylindrical blocking portion 139 of the spindle 59, thereby preventing movement of the cylindrical blocking portion 139 through the adjacent passageway 157. In this configuration, the locking surface 161 of each clutch 58 may be engaged with the cylindrical blocking portion 139 of the spindle 59 in order to prevent movement of the spindle 59 along its longitudinal axis away from the button 60. Since the spindle 59 cannot move away from the button 60, the locking structure 149 of the spindle 59 is still engaged with the locking notch 187 of the button 60, which prevents movement of the button 60 substantially perpendicular to the spindle 59 so that the button 60 cannot come into contact with the latch 39. As a result, when the combination locking mechanism is in the locked configuration, the button 60 cannot be used to disengage the latch 39 from the toe 18 of the shackle 16. It is understood that the square-shaped block 147 of the spindle 59 restricts and/or prevents rotational movement of the spindle 59 about its longitudinal axis, and as a result the spindle 59 is only permitted to move along its longitudinal axis.

As shown for example in FIGS. 2A, 2B, 2C, 3A and 3B, in the unlocked configuration of the combination locking mechanism, all of the indicia 173 of the dials 50 have been set to the correct indicia 173 for the code and/or combination of the combination locking mechanism. As a result, each clutch 58 is positioned so that the locking surface 161 of each clutch 58 is aligned with the flat-cut surface 141 of the spindle 59 so that movement of the spindle 59 along its longitudinal axis is no longer restricted by the clutches 58. Therefore, the button 60 may be urged in a direction towards the lock housing 15, which permits removal of the locking structure 149 of the spindle 59 from the locking notch 187 of the button 60. As the button 60 is urged towards the lock housing 15, the sloped side 189 of the locking notch 187 engages with the sloped face 151 of the locking structure 149, which causes movement of the spindle 59 away from the button 60 along the longitudinal axis of the spindle 59. As a result, the button 60 is free to be urged in a direction towards the toe 18 of the shackle 16, which results in the angled edge 186 of the button 60 contacting the slope 133 of the latch 39. This contact between the angled edge 186 and slope 133 results in movement of the latch 39 away from the button 60 in a direction substantially perpendicular to the movement of the button 60, and disengagement of the locking extension 119 of the latch 39 from the locking zone 25 of the shackle 16. The toe 18 of the shackle 16 may now be removed from the lock housing 15 either as the result of being pulled in a direction away from the lock housing 15 or through action of the shackle spring 211 operatively engaged with the heel 19 of the shackle 16 in order to place the shackle 16 into the open position. As a result of the shackle 16 being in the open position, the shackle 16 may be free to rotate about the heel 19 of the shackle 16 retained within the lock housing 15. However, it is understood that the shackle 16 may remain in the closed position even if the combination locking mechanism is placed in the unlocked configuration, since the shackle 16 may be kept within the lock housing 15 even if the latch 39 is disengaged from the toe 18 or even if the spindle 59 is free to move along its longitudinal axis, but the button 60 has not been urged in a direction towards the lock housing 15 in order to disengage the spindle 59 from the button 60. It is also understood that the button 60 is engaged with button spring 179 in order to urge the button 60 back to its original position such that the sloped side 189 of the button 60 will align back with sloped face 151 of spindle 59. As a result, the locking structure 149 of the spindle 59 will be aligned with the locking notch 187 of the button 60.

In order to place the combination locking mechanism back into the locked configuration and/or place the shackle 16 back into the closed position, the button 60 is no longer pushed in a direction towards the lock housing 15, which causes the button spring 179 to urge the button 60 back towards its original position, as mentioned above. With the locking structure 149 engaged with the locking notch 187 of the button 60, the cylindrical blocking portions 139 of the spindle 59 move out of the passageways 157 of the clutches 58 so that the dials 50 may be rotated in order to scramble the code and/or combination that has been entered into the combination locking mechanism. Therefore, the spindle 59 can no longer move away from the button 60, since at least one locking surface 161 of at least one of the clutches 58 prevents movement of the cylindrical blocking portions 139, and thereby prevents movement of the spindle 59. The shackle 16 may then be pushed in a direction towards the lock housing 15 so that the toe 18 is inserted back into the lock housing 15. As the shackle 16 is continued to be urged towards the lock housing 15, the beveled end 27 of the shackle 16 will contact the sloped tip 122 of the latch 39 urging the latch 39 in a direction away from the toe 18 of the shackle 16 and allowing the locking extension 119 to ultimately engage with the locking zone 25 of the shackle 16. In this manner, the combination locking mechanism has been used to place and retain the shackle 16 back into the closed position of the shackle 16. It is understood that the shackle 16 may be reengaged with the latch 39, and then the dials 50 rotated in order to place the combination locking mechanism back into the locked configuration. It is understood that in this manner, the padlock 10 may act as a self-locking system through engagement of the latch 39 with the toe 18 of the shackle 16.

It is further understood that if the shackle 16 is placed in the open position by the combination locking mechanism, that the key locking mechanism is not interrupted, and both locking mechanisms can move the latch 39 so as to place the shackle 16 into the open position without disturbing the other locking mechanism.

Figure 15B:
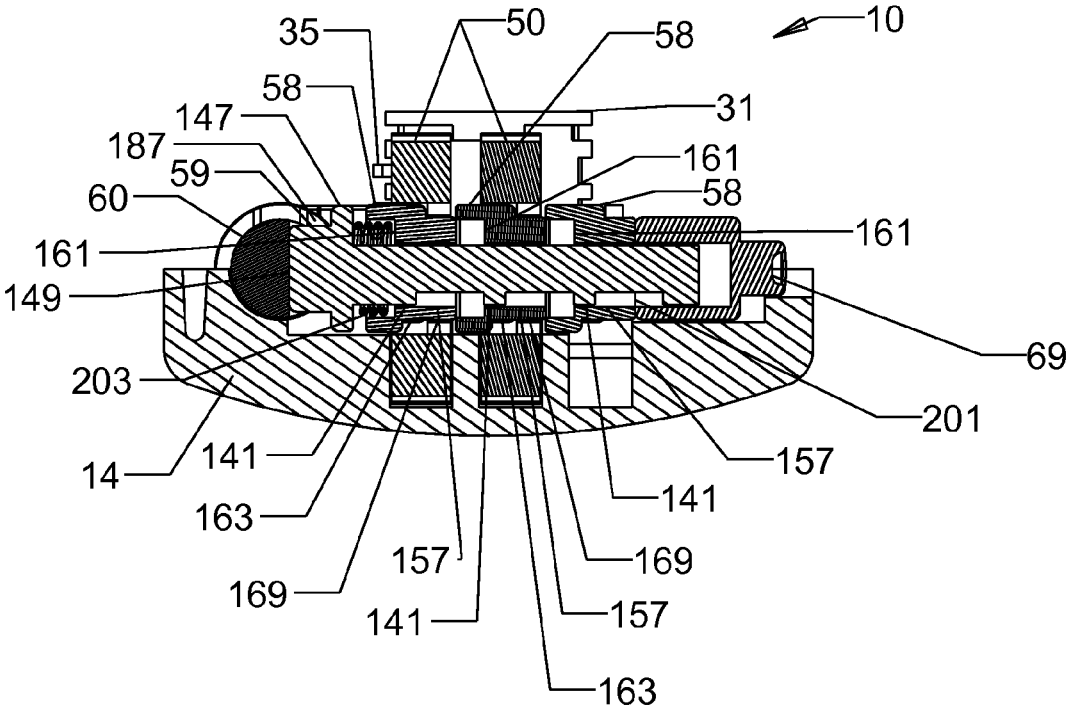
FIG. 15B is a cross-sectional view of the exemplary embodiment of the padlock taken along line 15B-15B of FIG. 15A.

As shown in FIGS. 15A and 15B, the combination locking mechanism of the padlock 10 according to the present invention may also include a reset mode in which it is possible to reset and/or reconfigure the code and/or combination that may be used to place the combination locking mechanism into the unlocked configuration. When the correct indicia 173 have been set on the dials 50, such that the dials 50 are set to the correct code and/or combination, the passageways 157 of clutches 58 align with the flat-cut surfaces 141 of the spindle 59. In this configuration, the reset button 69 can be urged towards the spindle 59 so that the solid end 201 of the reset button 69 pushes the clutches 58 in the same direction. As clutches 58 are being pushed, the extended fins 163 of the clutches 58 are all disengaged from teeth 169 of dials 50. The dials 50 can then be rotated without also rotating the clutches 58. After the code and/or combination have been reconfigured, the reset button 69 is released, which causes the spindle spring 203 to push the clutches 58 in a direction towards the reset button 69 so that the extended fins 163 of the clutches 58 will engage back with teeth 169 of the dials 50.

It is understood that the padlock 10, and its components, including but not limited to the shackle 16 and lock housing 15, may be made from any suitable materials. For example, the padlock 10 and its components may be made from any suitable metal, such as steel, aluminum, stainless steel, and/or any suitable plastics. The materials selected for each component of the padlock 10 may be dependent upon the desired durability and/or security of the component, as well as the cost associated with producing such component.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A padlock, comprising:

a lock housing;

a shackle comprising a toe having a toe longitudinal axis and a heel, wherein at least the heel of the shackle is retained within the lock housing, and the shackle is positionable between an closed position in which the toe is at least partially surrounded by the lock housing and an open position in which the toe is spaced away from the lock housing;

a latch positioned within the lock housing and configured to retain the shackle in the closed position;

a combination locking mechanism operatively connected to the latch and comprising a button having a button longitudinal axis and configured for operative engagement with the latch, and wherein the combination locking mechanism is operable between a locked configuration and an unlocked configuration and the button is configured to release the latch from the shackle when the combination locking mechanism is in the unlocked configuration; and a key locking mechanism operatively connected to the latch, and operable between a locked orientation and an unlocked orientation;

wherein the combination locking mechanism is configured to release the latch from the shackle when in the unlocked configuration;

wherein the key locking mechanism is configured to release the latch from the shackle when in the unlocked orientation;

wherein when the latch is released from the shackle, the shackle is positionable to the open position;

wherein the toe longitudinal axis and the button longitudinal axis are substantially coextensive so that the toe of the shackle and the button share a common centerline; and wherein the button is configured to rectilinear movement along the common centerline when the combination locking mechanism is in the unlocked configuration.

2. The padlock according to claim 1, wherein the shackle comprises a locking zone formed within the toe, and the latch comprises a locking extension configured for engagement with the locking zone of the shackle when the shackle is in the closed position, and wherein the locking extension is configured to retain the shackle in the closed position.

3. The padlock according to claim 1, wherein the combination locking mechanism comprises at least one dial, at least one clutch operatively engaged with the at least one dial and having a passageway, a spindle positioned through the passageway of the at least one clutch and configured for operative engagement the button.

4. The padlock according to claim 3, wherein the spindle is configured to restrict movement of the button when the combination locking mechanism is in the locked configuration so that the button cannot release the latch from the shackle.

5. The padlock according to claim 3, wherein the spindle comprises at least one cylindrical blocking portion, each of the cylindrical blocking portions having a flat cut surface, wherein each of the at least one clutches comprises a locking surface positioned adjacent to the passageway, and wherein each of the cylindrical blocking portions are configured for engagement with each of the passageways when all of the flat cut surfaces of each of the cylindrical blocking portions are aligned with all of the locking surfaces of each of the clutches.

6. The padlock according to claim 3, wherein the spindle comprises a locking structure formed at one end thereof, and the button comprises a locking notch configured for operative engagement with the locking structure of the spindle, wherein when the combination locking mechanism is in the locked configuration the locking structure is at least partially retained within the locking notch, and when the combination locking mechanism is in the unlocked configuration movement of the button removes the locking structure from the locking notch.

7. The padlock according to claim 1, wherein the button comprises a sloped side positioned at one end thereof, and the sloped side is configured for engagement with the latch such that engagement of the sloped side with the latch due to movement of the button causes movement of the latch in a direction substantially perpendicular to the movement of the button.

8. The padlock according to claim 3, wherein the combination locking mechanism further comprises a button spring configured to bias the button in a direction away from the latch, and a spindle spring configured to bias the spindle in a direction towards the button.

9. The padlock according to claim 2, further comprising a latch spring configured to bias the locking extension of the latch in a direction towards the locking zone of the toe so that the shackle is retained in the closed position.

10. The padlock according to claim 1, wherein the key locking mechanism comprises a disc tumbler cylinder having a longitudinal axis and configured for receipt of a key, a cylinder housing at least partially surrounding the disc tumbler cylinder and comprising at least one opening formed therein, and at least one wafer plate positionable between an extended position in which at least part of the wafer plate is in the opening and a retracted position in which the wafer plate is not within the opening.

11. The padlock according to claim 10, wherein the key is configured to move the at least one wafer plate between the extended position and the retracted position when inserted into the disc tumbler cylinder.

12. The padlock according to claim 10, wherein the key locking mechanism is configuration for positioning in the unlocked orientation when all of the at least one wafer plates are in the retracted position.

13. The padlock according to claim 10, wherein the key locking mechanism further comprises a cam operatively connected to the disc tumbler cylinder, and the disc tumbler cylinder is configured for rotational movement about its longitudinal axis when all of the at least one wafer plates are in the retracted position.

14. The padlock according to claim 13, wherein the cam is operatively connected to the disc tumbler cylinder so that rotational movement of the disc tumbler cylinder is transferred to the cam, and wherein the cam comprises an extended pusher configured for operative engagement with the latch.

15. The padlock according to claim 14, wherein when the key locking mechanism is in the unlocked orientation the extended pusher is configured to move the latch in a direction away from the toe of the shackle so that the latch releases the shackle and the shackle is free to move into the open position.

16. The padlock according to claim 1, wherein the combination locking mechanism and key locking mechanism are configured to contact the latch at different parts of the latch in order to cause movement the latch, which can then allow the shackle to be released from the closed position.

17. The padlock according to claim 1, further comprising a reset button configured to place the combination locking mechanism in a reset mode in which the combination for the combination locking mechanism can be reset or reconfigured when the combination locking mechanism is in the unlocked configuration.

18. The padlock according to claim 1, wherein the button further comprises a chamber formed in one end thereof and dimensioned for receipt of at least a portion of the toe of the shackle, and wherein the toe of the shackle is received in the chamber at least during rectilinear movement of the button along the common center line in a direction towards the toe of the shackle.

* * * * *